US006538238B1

(12) United States Patent
Berkcan et al.

(10) Patent No.: US 6,538,238 B1
(45) Date of Patent: Mar. 25, 2003

(54) LONG TERM CALIBRATION OF SENSOR ASSEMBLY FOR GLASS-CERAMIC COOKTOP APPLIANCE

(75) Inventors: Ertugrul Berkcan, Niskayuna, NY (US); Emilie Thorbjorg Saulnier, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/683,768

(22) Filed: Feb. 12, 2002

(51) Int. Cl.[7] ..... H05B 1/02

(52) U.S. Cl. ..... 219/502; 219/501; 219/497; 219/446.1; 250/338.1; 374/128; 374/132

(58) Field of Search ..... 219/502, 501, 219/497, 499, 494, 505, 446.1, 448.11; 374/121, 126, 128, 124, 132, 133; 236/49.3, 91 C, 68.8

(56) References Cited

U.S. PATENT DOCUMENTS

| | | | | | |
|---|---|---|---|---|---|
| 4,602,642 | A | * | 7/1986 | O'Hara et al. | 128/664 |
| 4,741,626 | A | * | 5/1988 | Hashimoto | 374/133 |
| 5,127,742 | A | * | 7/1992 | Fraden | 374/129 |
| 5,531,377 | A | * | 7/1996 | Thayer et al. | 236/49.3 |
| 6,111,228 | A | | 8/2000 | Berkcan et al. | |
| 6,118,105 | A | | 9/2000 | Berkcan et al. | |
| 6,133,552 | A | | 10/2000 | Saulnier et al. | |
| 6,140,617 | A | | 10/2000 | Berkcan et al. | |
| 6,169,486 | B1 | | 1/2001 | Berkcan et al. | |
| 6,184,672 | B1 | | 2/2001 | Berkcan | |

OTHER PUBLICATIONS

"Monitoring and Control System for Monitoring the Temperature of a Glass Ceramic Cooktop," Badami et al., Serial No. 09/684,426 (GE docket RD–26,381), filed Oct. 10, 2000.

* cited by examiner

*Primary Examiner*—Mark Paschall
(74) *Attorney, Agent, or Firm*—Donald S. Ingraham; Christian G. Cabou

(57) ABSTRACT

A sensor assembly for glass-ceramic cooktop appliances includes an optical detector having an reference component and an active component. The active component is arranged to receive radiation from the glass-ceramic plate, and the reference component is insulated from radiation from the glass-ceramic plate. The sensor assembly further includes a temperature sensor and a heater located adjacent to the reference component and a controller having a first input connected to the optical detector and a second input connected to the temperature sensor. The controller is responsive to the optical detector and the temperature sensor to calibrate the sensor assembly. Calibration is accomplished by noting the temperature reading of the temperature sensor after the burner assembly has not been used for a predetermined period of time to obtain a first calibration point. Then, the burner assembly is activated so that the temperature of the glass-ceramic plate is raised, and the output of the optical detector is noted. Next, an exciting circuit is used to heat the reference component. When the output of the optical detector reaches zero, the temperature reading of the temperature sensor is noted and used with the noted optical detector output to obtain a second calibration point. The first and second calibration points are used to calibrate the sensor assembly.

19 Claims, 4 Drawing Sheets

LONG TERM CALIBRATION OF SENSOR ASSEMBLY FOR GLASS-CERAMIC COOKTOP APPLIANCE

BACKGROUND OF INVENTION

This invention relates generally to glass-ceramic cooktop appliances and more particularly to the long term calibration of a device for sensing properties relating to the appliance.

The use of glass-ceramic plates as cooktops in cooking appliances is well known. Such glass-ceramic cooktops have a smooth surface that presents a pleasing appearance and is easily cleaned in that the smooth, continuous surface prevents spillovers from falling onto the heating unit underneath the cooktop.

In one known type of glass-ceramic cooktop appliance, the glass-ceramic plate is heated by radiation from a heating unit, such as an electric coil or a gas burner, disposed beneath the plate. The glass-ceramic plate is sufficiently heated by the heating unit to heat utensils upon it primarily by conduction from the heated glass-ceramic plate to the utensil. Another type of glass-ceramic cooktop appliance uses a heating unit that radiates substantially in the infrared region in combination with a glass-ceramic plate that is substantially transparent to such radiation. In these appliances, a utensil placed on the cooktop is heated primarily by radiation transmitted directly from the heating unit to the utensil, rather than by conduction from the glass-ceramic plate. Such radiant glass-ceramic cooktops are more thermally efficient than other glass-ceramic cooktops and have the further advantage of responding more quickly to changes in the power level applied to the heating unit.

In both types of glass-ceramic cooktop appliances, provision must be made to avoid overheating the cooktop. For most glass-ceramic materials, the operating temperature should not exceed 700° C. for any prolonged period. During operation, conditions can occur which can cause this temperature limit to be exceeded. Commonly occurring examples include operating the appliance with no load, i.e., no utensil, on the cooktop surface, using warped utensils that make uneven contact with the cooktop surface, and operating the appliance with a shiny and/or empty utensil.

To protect the glass-ceramic from extreme temperatures, glass-ceramic cooktop appliances ordinarily have some sort of temperature sensing device that can cause the heating unit to be shut down if high temperatures are detected. In addition to providing thermal protection, such temperature sensors can be used to provide temperature-based control of the cooking surface and to provide a hot surface indication, such as a warning light, after a burner has been turned off.

One common approach to sensing temperature in glass-ceramic cooktop appliances is to place a temperature sensor directly on the underside of the glass-ceramic plate. With this approach, however, the temperature sensor is subject to the high burner temperatures and thus more susceptible to failure. Moreover, direct contact sensors detect an average flux across the contact and do not produce a direct measurement of the glass-ceramic temperature. Thus, it is desirable to use an optical sensor assembly that "looks" at the glass-ceramic surface from a remote location to detect the temperature of the surface. Remote sensor assemblies are also capable of "looking" through the glass-ceramic plate to detect characteristics of a utensil placed on the cooktop, such as the temperature, size or type of the utensil, the presence or absence of the utensil, or the properties, such as boiling state, of the utensil contents.

Remote sensor assemblies are calibrated such that the sensor output signal will accurately represent the cooktop related property being detected. Over time, however, the system will experience certain effects that will affect the calibration and performance of the sensor assembly. These long term effects include aging of the glass-ceramic plate resulting in changes in its emissivity and reflectivity, formation of deposits on the glass-ceramic plate, the aging effects of the system's optical components, and drifts and variations in system electronics.

Accordingly, there is a need for a remote sensor assembly that can monitor and compensate for long term changes.

SUMMARY OF INVENTION

The above-mentioned needs are met by the present invention which provides a sensor assembly for glass-ceramic cooktop appliances that includes an optical detector having a reference component and an active component. The active component is arranged to receive radiation from the glass-ceramic plate, and the reference component is insulated from radiation from the glass-ceramic plate. The sensor assembly further includes a temperature sensor located adjacent to the reference component, means for exciting the reference component, and a controller having a first input connected to the optical detector and a second input connected to the temperature sensor. The controller is responsive to the optical detector and the temperature sensor to calibrate the sensor assembly. Calibration is accomplished by noting the temperature reading of the temperature sensor after the burner assembly has not been used for a predetermined period of time to obtain a first calibration point. Then, the burner assembly is activated so that the temperature of the glass-ceramic plate is raised, and the output of the optical detector is noted. Next, the exciting means are used to heat the reference component. Alternatively, the reference component could be heated first, followed by heating the glass-ceramic plate. Either way, when the output of the optical detector reaches zero, the temperature reading of the temperature sensor is noted and used with the noted optical detector output to obtain a second calibration point. The first and second calibration points are used to calibrate the sensor assembly.

Other objects and advantages of the present invention will become apparent upon reading the following detailed description and the appended claims with reference to the accompanying drawings.

BRIEF DESCRIPTION OF DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION

Figure 1:
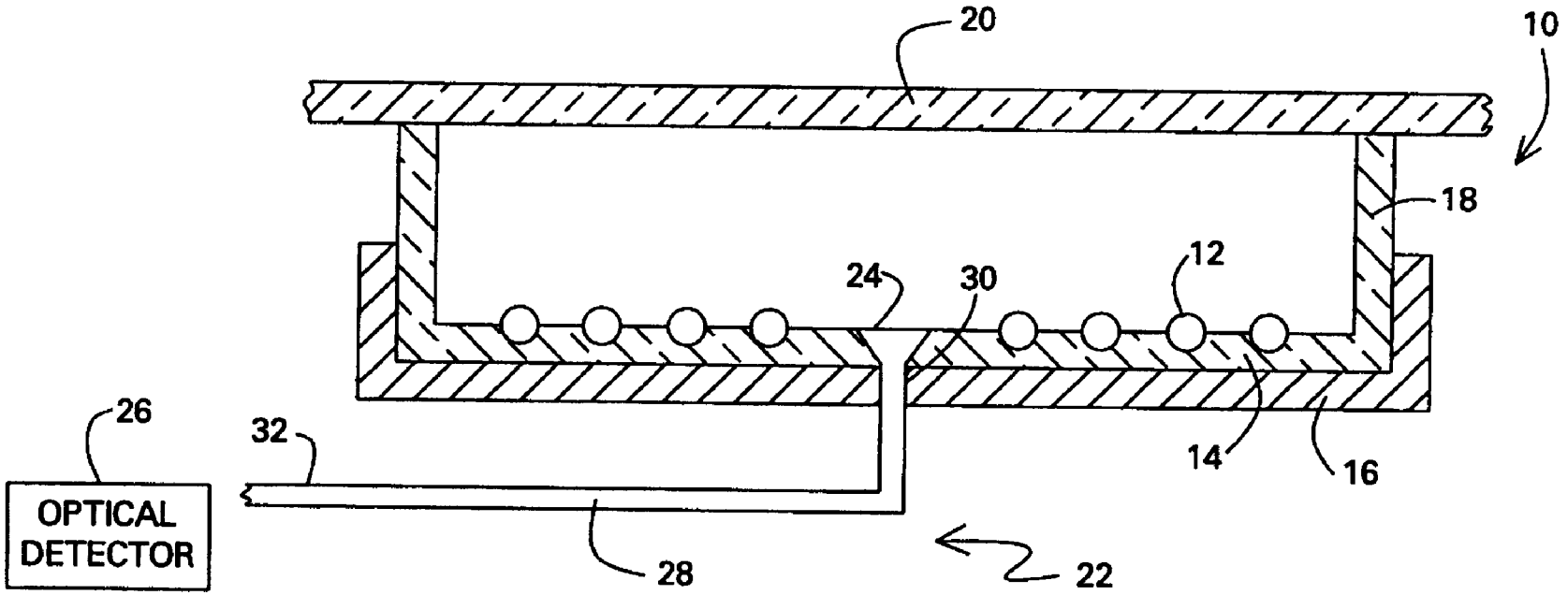
FIG. 1 is a sectional view of a burner assembly having the optical sensor assembly of the present invention.

Referring to the drawings wherein identical reference numerals denote the same elements throughout the various views, FIG. 1 shows a burner assembly 10 of the type suitable for use in a glass-ceramic cooktop appliance, which typically includes a plurality of such burner assemblies. As used herein, the term "cooktop" is intended to refer to both the flat top of a range or stove and counter-top cooking apparatuses (either built-in or portable). Burner assembly 10 includes an open coil electrical resistance element 12, which is designed when fully energized to radiate primarily in the infrared region of the electromagnetic energy spectrum. It should be noted that another type of heating unit, such as a gas burner, could be used in place of element 12. Element 12 is arranged in an effective heating pattern such as a concentric coil and is secured to the base of an insulating liner 14 which is supported in a sheet metal support pan 16. Insulating liner 14 includes an annular, upwardly extending portion 18 which serves as an insulating spacer between element 12 and a glass-ceramic plate 20 that provides the cooktop surface. Support pan 16 is spring loaded upwardly, forcing annular portion 18 into abutting engagement with the underside of glass-ceramic plate 20, by conventional support means (not shown).

An optical sensor assembly 22 is provided to detect one or more characteristics relating to the cooking appliance (referred to herein as "cooktop related properties"), such as the temperature of glass-ceramic plate 20, the presence or absence of a utensil on the cooktop, the temperature, size or type of utensil on the cooktop, or the properties or state of the utensil contents. Sensor assembly 22 includes a radiation collector 24 disposed in the interior of burner assembly 10 underneath glass-ceramic plate 20. This location provides radiation collector 24 with a field of view of the desired sensing location (i.e., the portion of glass-ceramic plate 20 directly over burner assembly 10). Radiation gathered by radiation collector 24 is delivered to an optical detector 26 located at a relatively cool place outside of burner assembly 10 via a light pipe or waveguide 28. Waveguide 28 allows detector 26 to be located where the thermal environment is more favorable. The use of waveguides also permits the co-location and sharing of detectors among several burner assemblies.

Waveguide 28 is preferably a metal tube having a highly reflective internal surface. More preferably, waveguide 28 is provided with an internal coating that is an excellent infrared reflector and has very low emissivity. Gold is one preferred internal coating material because of its high reflectivity and low emissivity. To prevent the tube material, which is preferably a metal such as copper, from bleeding into the internal coating, a barrier layer can be deposited between the metal tube and the internal coating. The barrier layer can comprise any suitable material, such as nickel or nichrome.

Waveguide 28 extends through the bottom of insulating liner 14 and support pan 16 so as to have a first or entry end 30 disposed in the interior of burner assembly 10 adjacent to radiation collector 24 and a second or exit end 32 located outside of burner assembly 10 adjacent to detector 26. Preferably, waveguide 28 extends through the bottom of insulating liner 14 and support pan 16 at their respective center points so as not to interfere with element 12.

As shown in FIG. 1, waveguide 28 is bent at a point intermediate its two ends so as to reflect radiation through a 90 degree turn. Thus, detector 26 is located not only below burner assembly 10 but also beyond its outer circumference. This configuration could alternatively be accomplished by providing waveguide 28 with a planar region formed at a 45 degree angle. Furthermore, it should be noted that waveguide 28 could also be straight, without any bend, so that detector 26 would be located directly below the point at which waveguide 28 extends through the bottom of insulating liner 14 and support pan 16. The waveguide 28 could alternatively have several bends.

Figure 2:
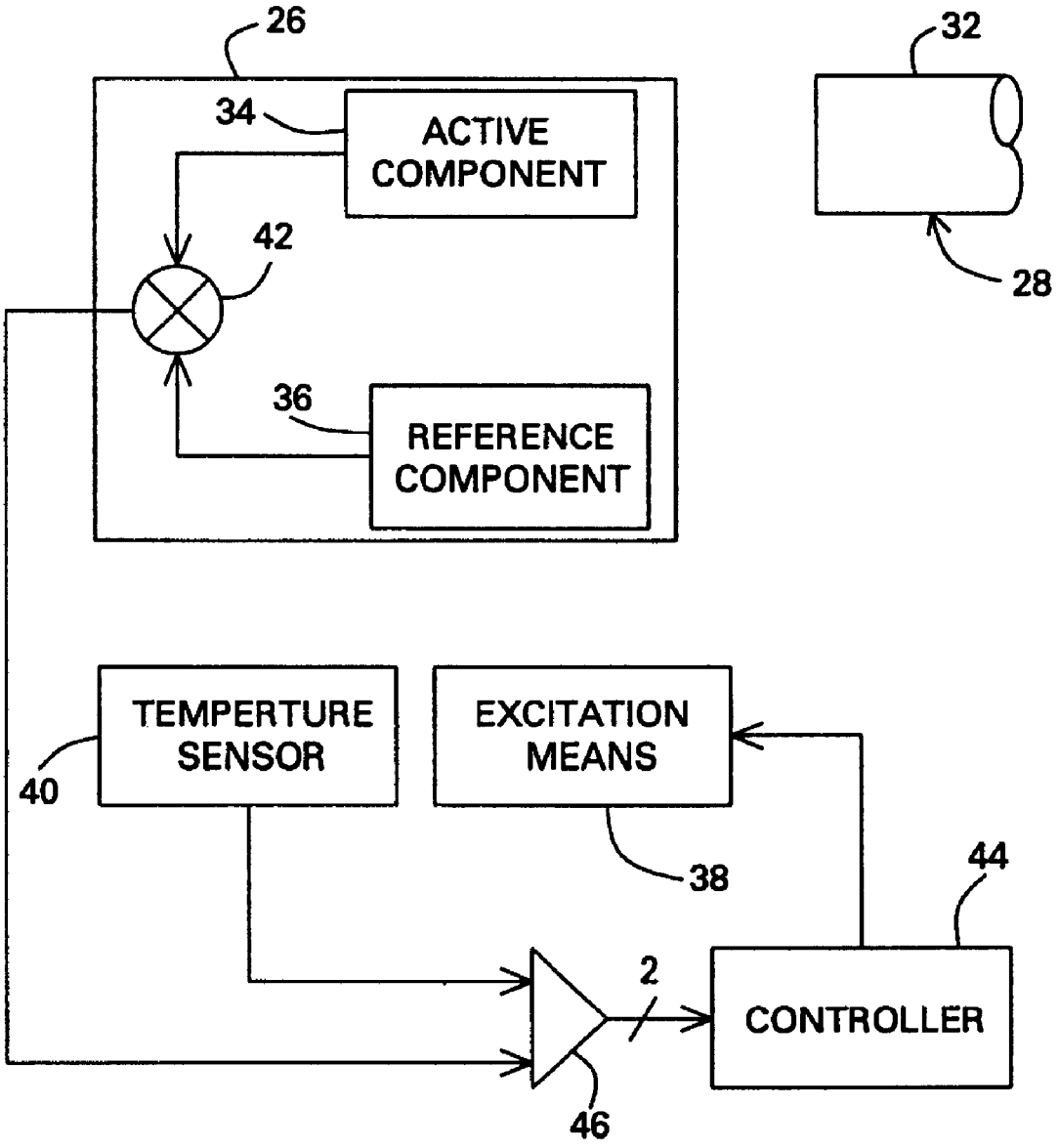
FIG. 2 is a schematic view of a portion of the sensor assembly of FIG. 1

Referring now to FIG. 2, it is seen that optical detector 26 comprises an active component 34 that is exposed to radiation exiting exit end 32 of waveguide 28 and a reference component 36 that is isolated from the radiation. An excitation means 38 and a temperature sensor 40 are located adjacent to reference component 36. Excitation means 38, which can be any device capable of heating or otherwise exciting reference component 36, is provided for selectively changing a condition (such as temperature) of reference component 36. Temperature sensor 40 is provided for sensing the temperature of reference component 36.

Active component 34 produces a first signal, and reference component 36 produces a second signal. These two signals are compared at a comparative junction 42. The comparative junction 42 provides a detector output that is a function of the first and second signals. The detector output signal is fed to an electronic controller 44, which is a common element used in many glass-ceramic cooktop appliances, via a multi-channel signal conditioner 46. The output of temperature sensor 40 is also fed to controller 44 via signal conditioner 46. Signal conditioner 46 is a conventional element comprising means for filtering or otherwise conditioning the signals as well as gain amplifying circuitry. Controller 44 provides a control signal to excitation means 38, causing reference component 36 to be excited.

Figure 3:
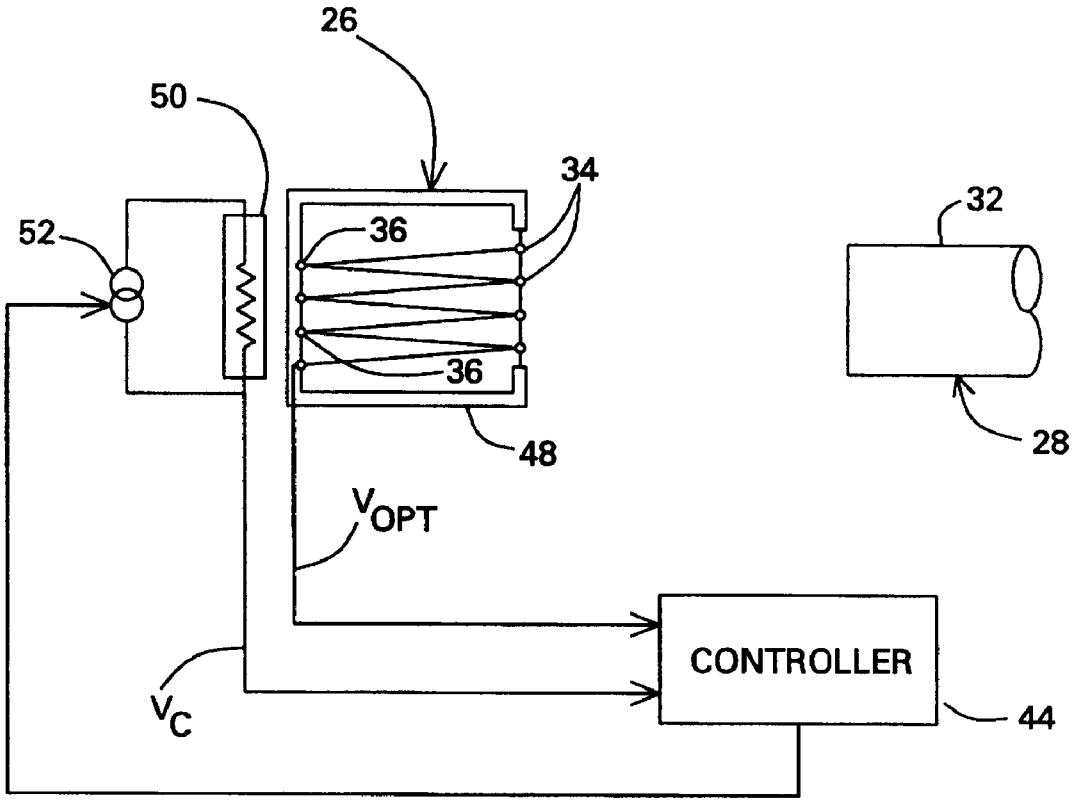
FIG. 3 is a schematic view of one preferred embodiment of an optical detector arrangement.

In one preferred embodiment, shown in FIG. 3, optical detector 26 is a thermopile, i.e., a plurality of series-connected thermocouples having hot junctions that function as active component 34 and cold junctions that function as reference component 36. It should be noted that a thermopile is one possible optical detector and that a wide variety of thermal and quantum detectors could be used. The thermopile is arranged in a casing 48 such that hot junctions 34 are exposed to the radiation exiting exit end 32 of waveguide 28, and cold junctions 36 are attached to casing 48 and isolated from the radiation. Accordingly, hot junctions 34 are heated to a temperature representative of the temperature of glass-ceramic plate 20, and cold junctions 36 are at the temperature of casing 48. Optical detector 26 produces a voltage or output signal, $V_{opt}$, which is representative of the difference in the temperature of hot junctions 34 and cold junctions 36. The output signal $V_{opt}$ is a positive value when the temperature of hot junctions 34 exceeds the temperature of cold junctions 36, is a negative value when the temperature of cold junctions 36 exceeds the temperature of hot junctions 34, and is zero when hot junctions 34 and cold junctions 36 are at equal temperatures. The output signal $V_{opt}$ is fed to controller 44 via signal conditioner 46 (not shown in FIG. 3).

In the embodiment of FIG. 3, a single element, a thermistor 50, functions as both excitation means 38 and temperature sensor 40. Specifically, thermistor 50 is located adjacent to the portion of casing 48 to which cold junctions 36 are attached. Thus, thermistor 50 produces an output signal, $V_c$, which is fed to controller 44 and representative of the casing temperature, and hence the temperature of cold junctions 36. Furthermore, thermistor 50 can be used to heat casing 48 and cold junctions 36. Thermistor 50 is powered by a current source 52. It should be noted that other devices, such as resistance temperature detectors and thermocouples, could be used as an alternative to a thermistor.

During normal operation of sensor assembly 22, controller 44 monitors the output signals $V_{opt}$ and $V_c$ to determine the temperature of glass-ceramic plate 20. Controller 44 utilizes a transfer function that relates the output signals $V_{opt}$ and $V_c$ to a corresponding temperature of glass-ceramic plate 20. In an ideal case, the transfer function is given by the following equation:

$$V_{opt}=\alpha(T_g^4-\gamma T_c^4)+\beta$$

where $T_g$ is the temperature of glass-ceramic plate 20, $T_c$ is the temperature of casing 48 (obtained from thermistor output signal $V_c$), $\alpha$ is the slope of the transfer function, $\beta$ is the offset value, and $\gamma$ is a constant generally assumed to be equal to one. The values of $\alpha$ and $\beta$ are set during the initial calibration of sensor assembly 22. The value of $V_{opt}$ is obtained from optical detector 26 such that the equation can be solved for $T_g$.

Figure 4:
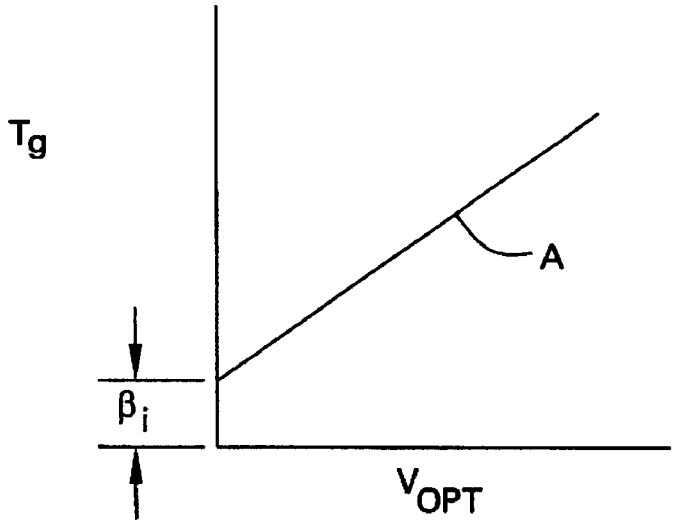
FIG. 4 is a plot showing an exemplary initial transfer function.

This concept is shown graphically in FIG. 4 in which the optical detector output signal $V_{opt}$ is plotted against the glass-ceramic temperature $T_g$. FIG. 4 shows an exemplary transfer function A (which for purposes of illustration is shown to be linear) that represents an initial calibration of sensor assembly 22 and has an initial slope $\alpha_i$ and an initial offset $\beta_i$. Over time, long term effects such as aging of glass-ceramic plate 20 and the optical components of sensor assembly 22, formation of deposits on glass-ceramic plate 20, and drifts and variations in system electronics can cause changes in the transfer function. For instance, the offset can change, the transfer function slope can change, or the shape of the transfer function can change (i.e., it becomes non-linear).

By the method of the present invention, controller 44 monitors the transfer function for any such changes and makes appropriate corrections so as to maintain the accuracy of sensor assembly 22. Generally, thermistor 50, functioning as a temperature sensor, is used to determine the glass-ceramic temperature Tg independently of optical detector 26. This is possible because the casing temperature Tc is equal to the glass-ceramic temperature Tg when the optical detector output signal $V_{opt}$ is zero. Thus, the thermistor output $V_c$ is representative of the glass-opt ceramic temperature Tg whenever a zero crossing occurs. By using such independent measurements of the glass-ceramic temperature Tg and monitoring the corresponding optical detector output signal $V_{opt}$, at predetermined intervals, two or more new calibration points can be obtained, stored in controller 44, and used for calibrating sensor assembly 22.

Figure 5:
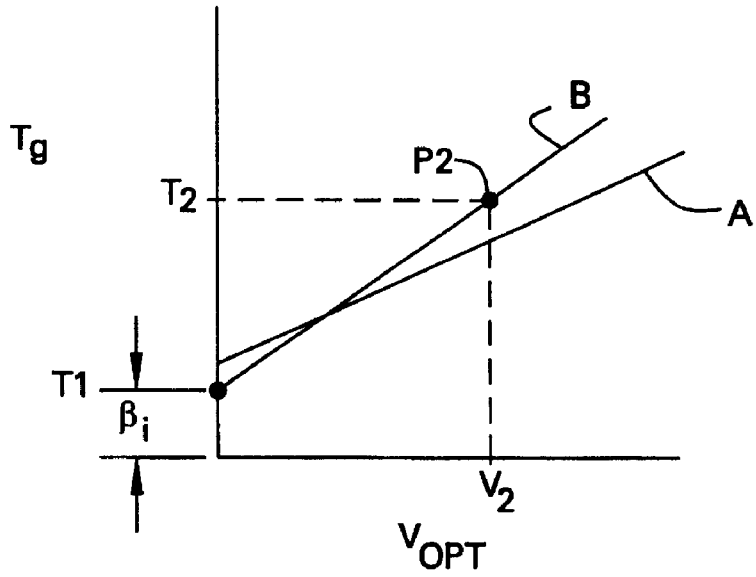
FIG. 5 is a plot showing a first updated transfer function compared to the initial transfer function.

Referring to FIG. 5, in which the optical detector output signal $V_{opt}$ is again plotted against the glass-ceramic temperature Tg, the method of the present invention is described in more detail. A first new calibration point P1 is obtained by carrying out a steady state glass-ceramic temperature measurement, i.e., after heating element 12 has not been energized for some predetermined time such that glass-ceramic plate 20 and casing 48 are at the same temperature, which would be room temperature. Because glass-ceramic plate 20 and casing 48 are at the same temperature, the optical detector output signal $V_{opt}$ is zero and the glass-ceramic temperature Tg is determined from thermistor 50. This measured temperature is set at a first value T1. Thus, as shown in FIG. 5, the first point P1 has a value of zero for the output signal $V_{opt}$ and the measured value T1 for the glass-ceramic temperature Tg. These values are fed to and stored in controller 44. Since the output signal $V_{opt}$ is zero, the first calibration point P1 will provide an indication of the offset $\beta$1, which can be compared to the original offset $\beta$i. If a change in offset has occurred, controller 44 will adjust the offset accordingly.

Next, a second new calibration point P2 is obtained. This is done by first energizing heating element 12 to heat glass-ceramic plate 20 such that its temperature is increased above room temperature, resulting in a positive value of the optical detector output signal $V_{opt}$. When glass-ceramic plate 20 reaches a constant temperature, the optical detector output signal $V_{opt}$ is noted by controller 44 and stored as a second value V2. Then, controller 44 feeds a control signal to thermistor 50, now functioning as an excitation means, causing it to heat casing 48 and cold junctions 36. When another zero crossing occurs, this means the casing temperature Tc has reached the glass-ceramic temperature Tg. At this point, the output of thermistor 50 (which is again functioning as a temperature sensor) is used to determine the new temperature of glass-ceramic plate 20, which is stored as a second value T2. It should be noted that a separate resistance heater could be used to heat casing 48. That is, it is not necessary to use a single device to function as excitation means 38 and temperature sensor 40.

Alternatively, calibration point P2 could be obtained by first heating casing 48 and cold junctions 36 to an elevated temperature and then energizing heating element 12 to heat glass-ceramic plate 20. When the zero crossing occurs, the optical detector output signal $V_{opt}$ is noted by controller 44 and stored as second value V2 and the output of thermistor 50 is stored as second value T2.

With either approach, the second point P2 has an output signal of V2 and a glass-ceramic temperature T2, as shown in FIG. 5. Second point P2 is fed to and stored in controller 44. Controller 44 uses first and second points P1 and P2 to determine an updated transfer function B and compares its slope with the slope of the initial transfer function A (shown in FIG. 5 for comparison). If change in slope has occurred, controller 44 adjusts it accordingly.

Figure 6:
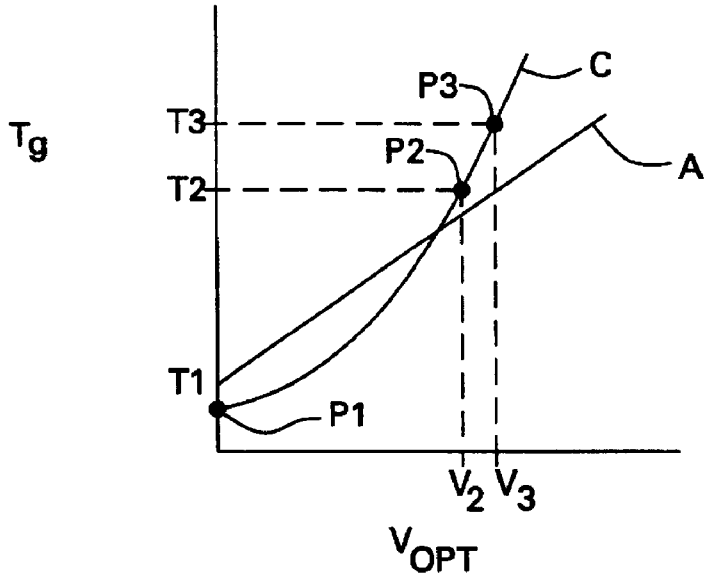
FIG. 6 is a plot showing a second updated transfer function compared to the initial transfer function.

Additional new calibration points can be determined by using the same heating process described above with respect to second point P2, but at different power levels. These additional points are then fed to and stored in controller 44. For example, FIG. 6 shows a third new calibration point P3 having an output signal of V3 and a measured glass-ceramic temperature T3. Controller 44 uses all three points to determine an updated transfer function C and compares its shape to the shape of the initial transfer function A (shown in FIG. 6 for comparison). If a change in shape has occurred, controller 44 adjusts it accordingly.

The foregoing has described a remote sensor assembly for a burner in a glass-ceramic cooktop appliance that can monitor and compensate for long term calibration changes. While specific embodiments of the present invention have been described, it will be apparent to those skilled in the art that various modifications thereto can be made without departing from the spirit and scope of the invention as defined in the appended claims.

What is claimed is:

1. A sensor assembly for a glass-ceramic cooktop appliance having at least one burner assembly disposed under a glass-ceramic plate, said sensor assembly comprising:

an optical detector having a reference component and an active component, said active component being arranged to receive radiation from said glass-ceramic plate and said reference component being insulated from radiation from said glass-ceramic plate;

a temperature sensor located adjacent to said reference component;

means for exciting said reference component; and a controller having a first input connected to said optical detector and a second input connected to said temperature sensor, said controller being responsive to said optical detector and said temperature sensor to calibrate said sensor assembly.

2. The sensor assembly of claim 1 wherein said active component produces a first signal and said reference component produces a second signal, and wherein said optical detector produces an output signal that is a function of said first and second signals.

3. The sensor assembly of claim 2 wherein output signal is the difference of said first and second signals.

4. The sensor assembly of claim 1 wherein said controller controls said means for exciting said reference component.

5. The sensor assembly of claim 1 wherein said means for exciting said reference component is a heater.

6. The sensor assembly of claim 1 wherein said temperature sensor and said means for exciting said reference component jointly comprise a thermistor.

7. The sensor assembly of claim 1 wherein said temperature sensor and said means for exciting said reference component jointly comprise a thermocouple.

8. The sensor assembly of claim 1 wherein said temperature sensor and said means for exciting said reference component jointly comprise a resistance temperature detector.

9. The sensor assembly of claim 1 wherein said optical detector is a thermopile having a plurality of hot junctions and a plurality of cold junctions, said hot junctions being said active component and said cold junctions being said reference component.

10. A sensor assembly for a glass-ceramic cooktop appliance having at least one burner assembly disposed under a glass-ceramic plate, said sensor assembly comprising:

an optical detector having a casing, said optical detector being arranged to receive radiation from said glass-ceramic plate;

a temperature sensor located adjacent to said casing;

means for heating said casing; and a controller having a first input connected to said optical detector and a second input connected to said temperature sensor, said controller being responsive to said optical detector and said temperature sensor to calibrate said sensor assembly.

11. The sensor assembly of claim 10 wherein said controller controls said means for heating said casing.

12. The sensor assembly of claim 10 wherein said temperature sensor and said means for heating said casing jointly comprise a thermistor.

13. The sensor assembly of claim 10 wherein said temperature sensor and said means for heating said casing jointly comprise a thermocouple.

14. The sensor assembly of claim 10 wherein said temperature sensor and said means for heating said casing jointly comprise a resistance temperature detector.

15. The sensor assembly of claim 1 wherein said optical detector is a thermopile.

16. The sensor assembly of claim 15 wherein said thermopile includes a plurality of hot junctions arranged to receive radiation from said glass-ceramic plate and a plurality of cold junctions attached to said casing and isolated from said radiation.

17. The sensor assembly of claim 16 wherein said optical detector produces an output signal that is representative of the difference in temperature between said hot junctions and said cold junctions.

18. A method of auto-calibrating a sensor assembly for a glass-ceramic cooktop appliance having at least one burner assembly disposed under a glass-ceramic plate, said method comprising the steps of:

providing an optical detector arranged to receive radiation from said glass-ceramic plate, said optical detector having an active component and a reference component;

providing a temperature sensor adjacent to said reference component;

noting the temperature reading of said temperature sensor after said burner assembly has not been used for a predetermined period of time and setting a first temperature value T1 equal to the noted temperature;

setting a first output value V1 equal to zero;

storing a first calibration point having T1 and V1 as its coordinates;

activating said burner assembly so that the temperature of said glass-ceramic plate is raised;

noting the output of said optical detector and setting a second output value V2 equal to the noted output;

heating said reference component while monitoring the output of said optical detector;

when the output of said optical detector reaches zero, noting the temperature reading of said temperature sensor and setting a second temperature value T2 equal to the newly noted temperature;

storing a second calibration point having T2 and V2 as its coordinates; and using said first and second calibration points to auto-calibrate said sensor assembly.

19. The method of claim 18 further comprising the steps of:

activating said burner assembly so that said glass-ceramic plate is raised to a third temperature;

noting the output of said optical detector and setting a third output value V3 proportional to the noted output;

further heating said reference component while monitoring the output of said optical detector;

when the output of said optical detector reaches zero, noting the temperature reading of said temperature sensor and setting a third temperature value T3 equal to the newly noted temperature;

storing a third calibration point having T3 and V3 as its coordinates; and using said first, second and third calibration points to auto-calibrate said sensor assembly.

* * * * *